US012669283B2

(12) United States Patent
Egoshi

(10) Patent No.: US 12,669,283 B2
(45) Date of Patent: Jun. 30, 2026

(54) MULTISTAGE BATH CONDENSER-REBOILER AND CRYOGENIC AIR SEPARATION UNIT USING THE SAME

(71) Applicant: TAIYO NIPPON SANSO CORPORATION, Tokyo (JP)

(72) Inventor: Nobuaki Egoshi, Tokyo (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 201 days.

(21) Appl. No.: 17/785,792

(22) PCT Filed: Dec. 16, 2020

(86) PCT No.: PCT/JP2020/046954

§ 371 (c)(1),
(2) Date: Jun. 15, 2022

(87) PCT Pub. No.: WO2021/125224

PCT Pub. Date: Jun. 24, 2021

(65) Prior Publication Data

US 2023/0079087 A1 Mar. 16, 2023

(30) Foreign Application Priority Data

Dec. 17, 2019 (JP) ..... 2019-227196

(51) Int. Cl.
*F25J 3/04* (2006.01)
*F28D 9/00* (2006.01)
*F28F 3/02* (2006.01)

(52) U.S. Cl.
CPC ..... *F25J 3/04412* (2013.01); *F28D 9/0037* (2013.01); *F28F 3/02* (2013.01)

(58) Field of Classification Search
CPC ..... F25J 3/0443; F25J 3/04048; F25J 3/044; F25J 3/0429; F25J 3/04787;
(Continued)

(56) References Cited

U.S. PATENT DOCUMENTS 6,393,864 B1 * 5/2002 Darredeau ..... F28F 27/02 62/643
10,408,535 B2 9/2019 Egoshi
(Continued)

FOREIGN PATENT DOCUMENTS

CN 1912513 A * 2/2007 ..... F25J 3/04624
EP 1067344 A1 1/2001
(Continued)

OTHER PUBLICATIONS

Extended European Search Report mailed Dec. 8, 2023 in European Application No. 20902035.3, 12 pages.
(Continued)

*Primary Examiner* — Joel M Attey
*Assistant Examiner* — Ibrahim A. Michael Adeniji
(74) *Attorney, Agent, or Firm* — Nixon & Vanderhye P.C.

(57) ABSTRACT

A multistage bath condenser-reboiler includes a heat exchange core including a heat exchange section formed by adjacently stacking an evaporation passage through which liquid to be evaporated flows, and which is partitioned into a plurality of stages, and a condensation passage through which gas is condensed by heat exchange with the liquid; a liquid reservoir which is configured to store liquid which is supplied into the evaporation passage or flowed out from the evaporation passage; and a liquid communication passage which is configured to flow the liquid in the liquid reservoir from an upper liquid reservoir into a lower liquid reservoir; and the liquid reservoir is provided for each evaporation passage partitioned into the plurality of stages on at least one side surface in a width direction of the heat exchanger core. The condensation passage is divided at least two stages.

3 Claims, 3 Drawing Sheets

(58) Field of Classification Search
CPC ..... F25J 3/04884; F25J 5/005; F25J 2200/72; F25J 2210/42; F25J 2250/10; F25J 2290/32; F25J 2290/40; F25J 3/04412; F28D 2021/0033; F28D 9/0037; F28F 3/02
See application file for complete search history.

(56) References Cited

U.S. PATENT DOCUMENTS

| | | | | |
|---|---|---|---|---|
| 2005/0028554 | A1 | 2/2005 | Wanner et al. | |
| 2017/0227284 | A1* | 8/2017 | Egoshi ..... | F25J 3/04212 |

FOREIGN PATENT DOCUMENTS

| | | |
|---|---|---|
| JP | 63-267877 | 11/1988 |
| JP | 2003-535300 | 11/2003 |
| JP | 6087326 | 3/2017 |
| JP | 2019-174070 | 10/2019 |
| WO | 2016/027889 | 2/2016 |

OTHER PUBLICATIONS

International Search Report dated Mar. 2, 2021, for PCT/JP2020/046954, 4 pp., including English translation.

* cited by examiner

MULTISTAGE BATH CONDENSER-REBOILER AND CRYOGENIC AIR SEPARATION UNIT USING THE SAME

This application is the U.S. national phase of International Application No. PCT/JP2020/046954 filed Dec. 16, 2020 which designated the U.S. and claims priority to JP Patent Application No. 2019-227196 filed Dec. 17, 2019, the entire contents of each of which are hereby incorporated by reference.

TECHNICAL FIELD

The present invention relates to a multistage bath condenser-reboiler in which liquid in a liquid reservoir provided in at least two evaporation zones is introduced into an evaporation passage, the liquid is evaporated by utilizing thermosiphon action by heat exchange between the liquid and gas flowing through the condensation passage, while the gas is condensed, and a cryogenic air separation unit using the multistage bath condenser-reboiler.

BACKGROUND ART

A condenser-reboiler indirectly exchanges heat between liquid oxygen from the bottom of a low-pressure distillation column (hereinafter referred to as "low-pressure column") and nitrogen gas from the top of a high-pressure distillation column (hereinafter referred to as "high-pressure column") in a cryogenic air separation unit by a double column system. As a result, some of the liquid oxygen is evaporated and vaporized to generate ascending gas in the low-pressure column, and the nitrogen gas is condensed and liquefied to generate a reflux liquid in the high-pressure column and the low-pressure column.

As such a condenser-reboiler, a plate fin heat exchanger including a condensation passage and an evaporation passage is used. Patent Document 1 discloses a multistage bath condenser-reboiler including a condensation passage which communicates from the upper end to the lower end and an evaporation passage having a plurality of evaporation zones in the vertical direction.

In such a multistage bath condenser-reboiler, liquid reservoirs for storing liquid oxygen is provided in each of a plurality of partitioned evaporation zones. Therefore, the liquid head of the liquid oxygen flowing into the evaporation passage from each liquid reservoir is small. Accordingly, increase of the boiling point is suppressed, and the liquid oxygen can be efficiently evaporated.

Due to this, there is an advantage in that the temperature difference with nitrogen gas can be reduced, the pressure of the high-pressure column is lowered, and the operating cost can be reduced.

FIG. 3 is a schematic diagram showing a heat exchange block 110 of a conventional multistage bath condenser-reboiler.

The heat exchange block 110 includes: a heat exchange core 7 provided with a heat exchange section 3 including condensation passages 10 communicating vertically and evaporation passages 2 partitioned into six evaporation zones E1, E2, E3, E4, E5, and E6, and liquid communication sections 5 provided on both sides (in a stacking direction of the condensation passage 10 and the evaporation passage 2); and a five-stage liquid reservoir 6 provided on both sides of the heat exchanger core 7 in a width direction orthogonal to the stacking direction.

The nitrogen gas to be condensed flows into the condensation passage 10 through a gas header 80 at the top, is condensed by heat exchange with the liquid oxygen flowing through the adjacent evaporation passage 2, and is discharged through a liquid header 90 at the bottom.

On the other hand, the liquid oxygen that exchanges heat with the nitrogen gas is supplied into the liquid reservoir 6 at the uppermost stage of the heat exchange block 110, exchanges heat with the nitrogen gas flowing through the condensation passage 10, flows into the evaporation passage 2 from an evaporation passage inlet 21 at the bottom of the evaporation zone E1, ascends while evaporating, and flows out into the liquid reservoir 6 from an evaporation passage outlet 22 at the upper part of the evaporation zone in gas-liquid two-phase flow.

The oxygen gas flowing out into the liquid reservoir 6 is discharged from the upper part of the liquid reservoir 6, and the liquid oxygen that has not evaporated is returned into the liquid reservoir 6 again. When the liquid level of the liquid reservoir 6 becomes higher than a liquid communication section inlet 51 of the liquid communication section 5, the liquid oxygen is introduced into the liquid communication passage from the liquid communication section inlet 51, and is supplied into the liquid reservoir 6 from a liquid communication section outlet 52 of the evaporation zone E2. Similar evaporation is performed in the evaporation zones E2 to E5. However, the liquid oxygen introduced from the liquid reservoir 6 of the evaporation zone E5 into the liquid communication section 5 is supplied from the bottom of the passage into the bottom of the container (not shown) accommodating the heat exchange block 110, and some of the liquid oxygen is evaporated in the evaporation zone E6. Oxygen gas generated in each evaporation zone is collected in the container, and some is collected as product $GO_2$.

PRIOR ART DOCUMENTS

Patent Literature

Patent Document 1 Japanese Patent No. 6087326

SUMMARY OF INVENTION

Problem to be Solved by the Invention

In the multistage bath condenser-reboiler, when the heat transfer area is increased in order to reduce the temperature difference between the oxygen gas and the nitrogen gas, the number of the evaporation zones (number of stages) is generally increased.

However, if the number of the evaporation zones is increased, there is a problem in that the heat exchange efficiency deteriorates. This problem will be described by taking as an example multistage bath condenser-reboilers A, B, and C in which the number of evaporation zones is 4, 5, and 6, respectively.

In the condensation passage, the entire amount of nitrogen gas flowing in from the top is liquefied at the bottom, so if the liquefied liquid flow rate is 100, the liquid flow rate profile in the condensation passage of each evaporation zone in each multistage bath condenser-reboiler A, B, and C is as shown in Table 1.

In Table 1, the multistage bath condenser-reboiler is simply referred to as a condenser-reboiler.

TABLE 1

| | | Condenser-reboiler A | | Condenser-reboiler B | | Condenser-reboiler C | |
|---|---|---|---|---|---|---|---|
| Heat transfer area | | 4 | | 5 | | 6 | |
| Number of evaporation zones | | 4 | | 5 | | 6 | |
| Zone 1 | Inlet | 0 | (13) | 0 | (10) | 0 | (8) |
| (E1) | Outlet | 25 | | 20 | | 17 | |
| Zone 2 | Inlet | 25 | (38) | 20 | (30) | 17 | (25) |
| (E2) | Outlet | 50 | | 40 | | 33 | |
| Zone 3 | Inlet | 50 | (63) | 40 | (50) | 33 | (42) |
| (E3) | Outlet | 75 | | 60 | | 50 | |
| Zone 4 | Inlet | 75 | (88) | 60 | (70) | 50 | (58) |
| (E4) | Outlet | 100 | | 80 | | 67 | |
| Zone 5 | Inlet | | | 80 | (90) | 67 | (75) |
| (E5) | Outlet | | | 100 | | 83 | |
| Zone 6 | Inlet | | | | | 83 | (92) |
| (E6) | Outlet | | | | | 100 | |

The numbers in parentheses are average values.

As shown in Table 1, in the case of the multistage bath condenser-reboiler A having 4 evaporation zones, the liquid flow rate is 100 at the outlet of evaporation zone 4 (simply referred to as "zone 4" in the table) at the bottom. Therefore, assuming that the condensation amount is equal in the condensation passage corresponding to each evaporation zone, the condensation amount in each evaporation zone is 25. In other words, the liquid flow rate is 0 at the inlet and 25 at the outlet in the evaporation zone 1. The liquid flow rate is 25 at the inlet and 50 at the outlet in the evaporation zone 2. The liquid flow rate is 50 at the inlet and 75 at the outlet in the evaporation zone 3. The liquid flow rate is 75 at the inlet and 100 at the outlet in the evaporation zone 4. In Table 1, the liquid flow rate obtained by averaging the liquid flow rates at the inlet and outlet of each zone is shown in parentheses.

As shown in Table 1, in any of the multistage bath condenser-reboilers, the liquid flow rate increases toward the lower evaporation zone. It can be understood that as the number of the evaporation zone increases, the liquid flow rate in the lowest evaporation zone increases.

As is clear from Table 1, increasing the number of evaporation zones increases the heat transfer area at which the liquid flow rate is high for the condensation passage. As a result, the liquid film thickness becomes large in the passage of the evaporation zone at which the liquid flow rate is large, and the efficiency of condensation decreases. Therefore, even if the heat transfer area is increased by increasing the number of evaporation zones, the temperature difference between oxygen gas and nitrogen gas does not decrease accordingly, and a problem arises in that the size of the multistage bath condenser-reboiler is inefficiently large. Furthermore, there is a problem in that a cold box for insulating low-temperature equipment including the multistage bath condenser-reboiler becomes large, and the equipment cost increases.

The present invention has been made to solve such a problem, and the object of the present invention is to provide a multistage bath condenser-reboiler capable of suppressing a decrease in condensation efficiency and making it compact, and a cryogenic air separation unit provided with the multistage bath condenser-reboiler.

Means for Solving the Problem

The present invention provides the following multistage bath condenser-reboiler and a cryogenic air separation unit in order to solve the above problems.

(1) A multistage bath condenser-reboiler, including:

a heat exchange core including a heat exchange section formed by adjacently stacking an evaporation passage through which liquid to be evaporated flows, and which is partitioned into a plurality of stages, and formed by plates and fins, and a condensation passage through which gas is condensed by heat exchange with the liquid, and which is formed by plates and fins;

a liquid reservoir which is configured to store liquid which is supplied into the evaporation passage or flowed out from the evaporation passage; and a liquid communication passage which is configured to flow the liquid in the liquid reservoir from an upper liquid reservoir into a lower liquid reservoir; and the liquid reservoir is provided for each evaporation passage partitioned into the plurality of stages on at least one side surface in a width direction of the heat exchanger core, which is orthogonal to a stacking direction of the condensation passage and the evaporation passage, wherein the condensation passage is divided at least two stages, and wherein the multistage bath condenser-reboiler further includes:

a gas header which is provided at the top of each stage of the condensation passage to supply the gas into the condensation passage of each stage;

condensation inlet flow channels which introduce the gas supplied in the gas header into the condensation passage;

a liquid header which is provided at the bottom of each stage of the condensation passage, and collects liquid generated by condensation of the gas in the condensation passage, and condensation outlet flow channels which flow out the liquid generated by condensation into the liquid header.

(2) The multistage bath condenser-reboiler according to (1), wherein the heat exchange core further includes a liquid communication section which forms the liquid communication passage, and provided on at least one side surface in a stacking direction of the heat exchange core.

(3) A cryogenic air separation unit including the multistage bath condenser-reboiler according to (1) or (2).

Effects of the Invention

In the multistage bath condenser-reboiler according to the present invention, the condensation passage is divided into at least two stages, and the multistage bath condenser-reboiler includes a gas header which is provided at the top of each stage of the condensation passage to supply gas into the condensation passage of each stage, the condensation inlet flow channels which introduce the gas supplied in the gas header into the condensation passage, the liquid header which is provided at the bottom of each stage of the condensation passage, and collects liquid generated by condensation of the gas in the condensation passage, and the condensation outlet flow channels which flow out the liquid generated by condensation into the liquid header. As a result, it is possible to suppress a decrease in condensation efficiency of the multistage bath condenser-reboiler and reduce the size.

DETAILED DESCRIPTION OF THE PREFERRED EMBODIMENTS

Figure 1:
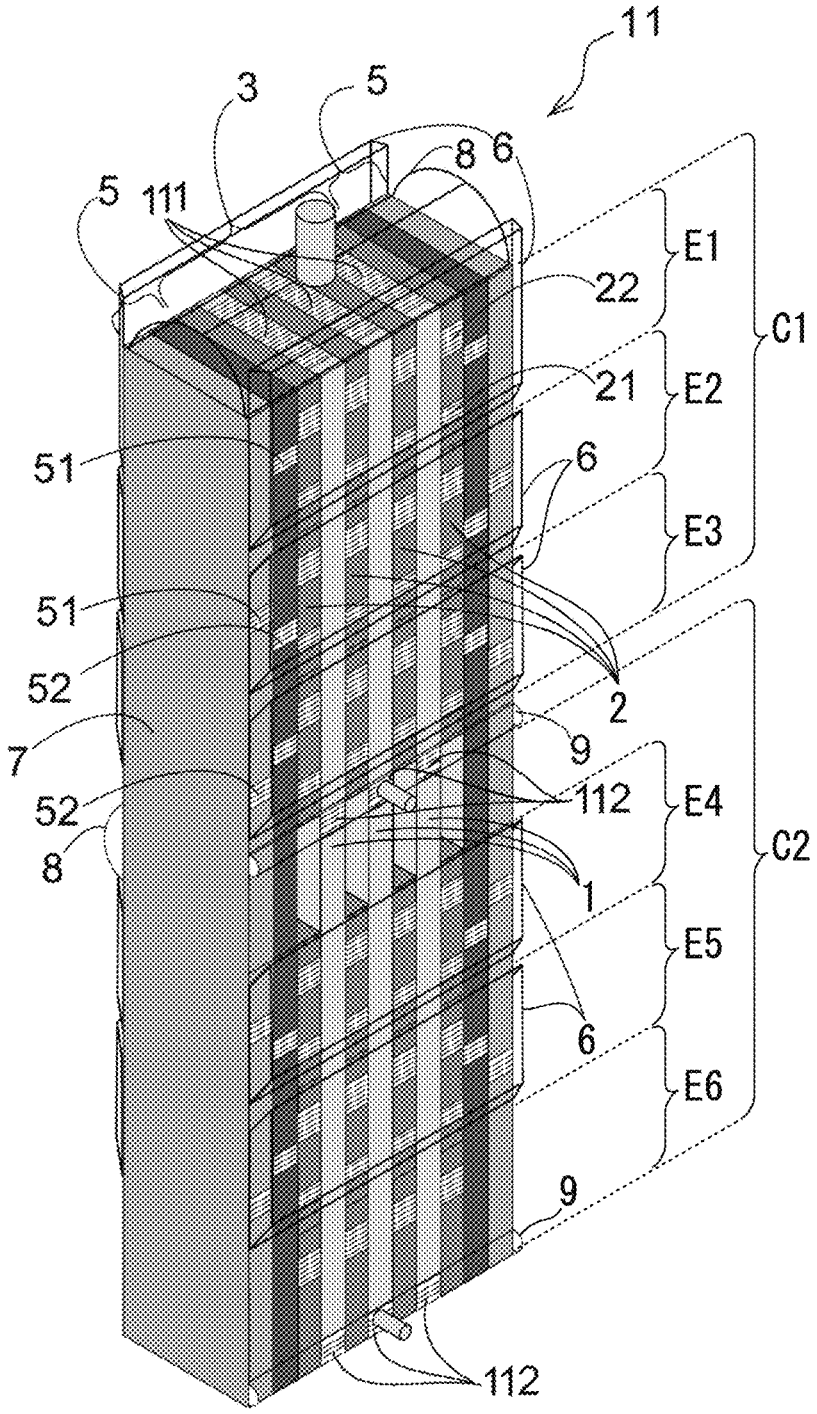
FIG. 1 is an explanatory diagram of a heat exchange block in a multistage bath condenser-reboiler according to an embodiment of the present invention.
Figure 3:
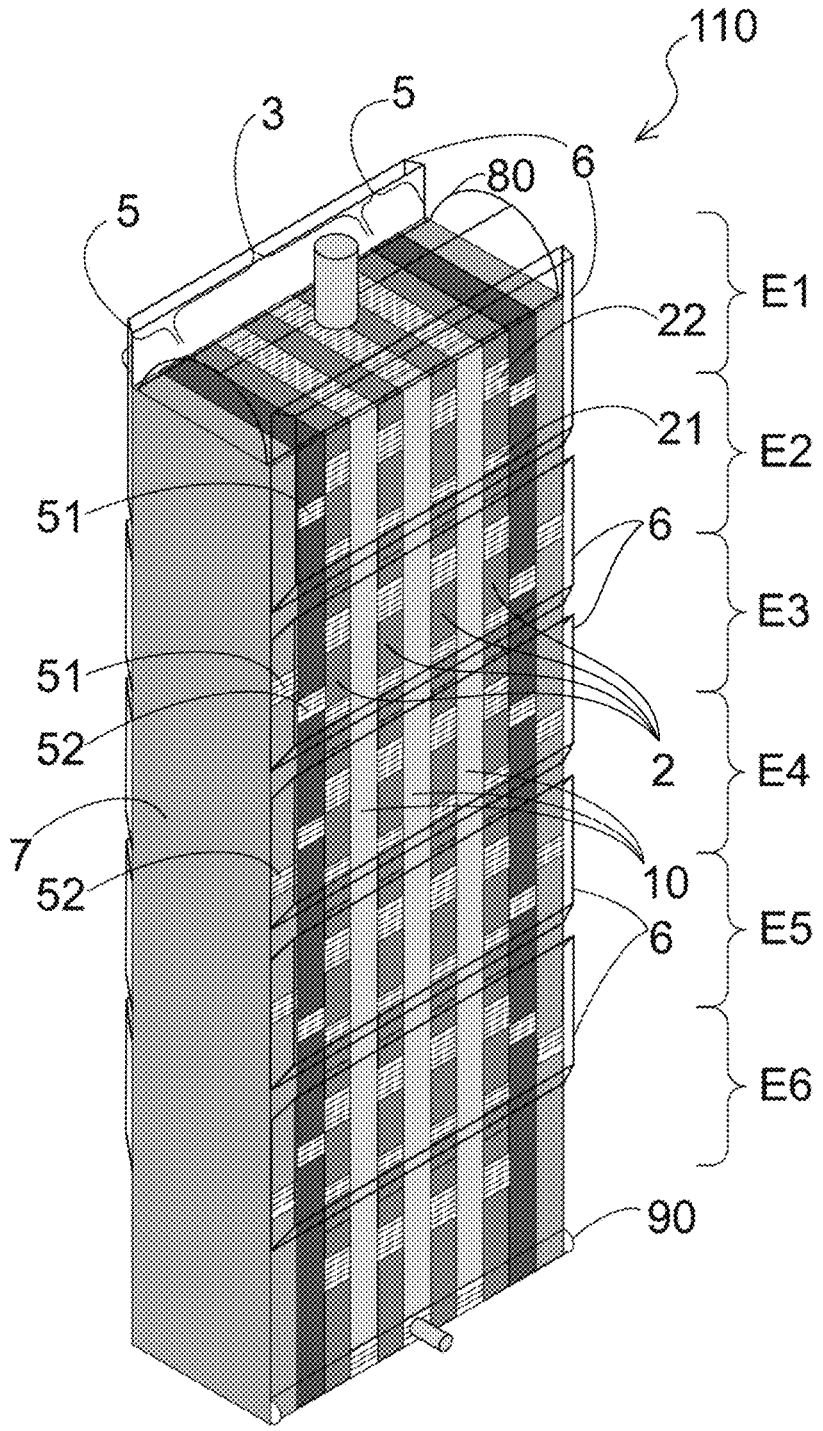
FIG. 3 is an explanatory diagram of a heat exchange block in a conventional multistage bath condenser-reboiler.

The multistage bath condenser-reboiler according to the present embodiment will be described with reference to FIG. 1 showing a heat exchange block 11, which is the main component thereof. In FIG. 1, the same parts as those in FIG. 3 and the corresponding parts showing the conventional example are designated by the same reference numerals.

As shown in FIG. 1, the heat exchange block 11 of the multistage bath condenser-reboiler according to the embodiment of the present invention includes evaporation passages 2 each of which is divided into 6 stages (E1 to E6) and through which evaporating liquid oxygen flows, liquid reservoirs 6 which store liquid supplied from and discharged into the evaporation passage 2, liquid communication sections 5 which form liquid communication passages for flowing the liquid in the liquid reservoir 6 from the upper liquid reservoir 6 into the lower liquid reservoir 6, and condensation passages 1 through which nitrogen gas that exchanges heat with liquid oxygen and condenses flows.

In the present embodiment, the heat exchange block 11 of the multistage bath condenser-reboiler includes a heat exchange core 7 including a heat exchange section 3 formed by stacking the evaporation passage 2 and the condensation passage 1 and liquid communication sections 5 formed by plates and fins.

The liquid reservoir 6 is provided in each stage of the evaporation passages 2 on both sides of the heat exchanger core 7.

Further, the condensation passage 1 is divided into two stages, an upper condensation zone (C1) and a lower condensation zone (C2). At the upper part of the upper condensation zone (C1) and the upper part of the lower condensation zone (C2), a gas header 8 that supplies nitrogen gas into each of the upper condensation zone (C1) and the lower condensation zone (C2) via the condensation inlet flow channels 111 are provided.

Further, at the lower part of the upper condensation zone (C1) and the lower part of the lower condensation zone (C2), a liquid header 9 that collects liquefied nitrogen generated in the upper condensation zone (C1) and the lower condensation zone (C2) via condensation outlet flow channels 112 is provided.

The liquid communication passage formed by the liquid communication sections 5 is provided so that the fluid flows continuously from the upper end to the lower end of the heat exchange core 7. That is, in the present embodiment, the condensation passage 1 is divided into two stages, the upper condensation zone (C1) and the lower condensation zone (C2). However, as in the conventional example shown in FIG. 3, the liquid communication passage is continuous from the upper end to the lower end of the heat exchange core 7 without being partitioned in the middle and discharging and supplying the fluid.

The liquid communication passage in the present embodiment includes the liquid communication sections 5 formed by plates and fins on both sides of the heat exchange core 7 in the stacking direction. However, it is not essential that the liquid communication passage be provided integrally with the heat exchange core 7, and it may be formed by, for example, a pipe connecting each liquid reservoir 6 separately from the heat exchange core 7.

Further, the liquid communication section 5 is provided on both sides of the heat exchange core 7 in the stacking height direction in the present embodiment, but the liquid communication section 5 may be provided on one side.

The operation of the multistage bath condenser-reboiler of the present embodiment described above will be described.

The liquid oxygen is supplied into the liquid reservoir 6 at the uppermost stage, into the evaporation passage 2 from the evaporation passage inlet 21 at the lower part of the evaporation zone E1 by heat exchange with the nitrogen gas flowing through the condensation passage 1, ascends while evaporating, and flows out into in the gas-liquid two-phase flow into the liquid reservoir 6 from the evaporation passage outlet 22 at the upper part of the evaporation zone E1.

The oxygen gas flowing out into the liquid reservoir 6 is discharged from the upper part of the liquid reservoir 6. The liquid oxygen that has not evaporated is returned into liquid reservoir 6 again. When the liquid level of the liquid reservoir 6 becomes higher than the position of the liquid communication section inlet 51 of the liquid communication section 5, the liquid oxygen flows into the liquid communication section 5 from the liquid communication section inlet 51, and is then supplied into the lower liquid reservoir 6 from the liquid communication section outlet 52 in the evaporation zone E2.

Similarly, in the evaporation zone E2, evaporation and liquid supply to the third stage by the liquid communication passage are performed. In the subsequent evaporation zones E3, E4, E5, and E6, evaporation and liquid supply are repeated in the same manner. However, in the evaporation zone E6, the liquid oxygen introduced in the liquid communication section 5 of the evaporation zone E5 is supplied from the bottom of the liquid communication passage to the bottom of the container (not shown) for accommodating the heat exchange block 11, and some of the liquid oxygen evaporates.

On the other hand, nitrogen gas flows in the heat exchange block 11 from the gas headers 8 provided at the top and the middle of the heat exchange block 11. The nitrogen gas flowing in from the top is condensed in the upper condensation zone (C1), and the nitrogen gas flowing in from the middle is condensed in the lower condensation zone (C2) by heat exchange with the liquid oxygen flowing through the evaporation passage 2, and discharged as liquid nitrogen from the liquid headers 9 provided at the middle and the bottom, respectively.

Table 2 shows comparisons between the liquid flow profile in the condensation passage 1 in the multistage bath condenser-reboiler shown in FIG. 1 and the liquid flow profile in the condensation passage in the conventional multistage bath condenser-reboiler (FIG. 3) having the same heat transfer area as that of the multistage bath condenser-reboiler shown in FIG. 1.

The liquid flow rate shown in Table 2 is the liquid flow rate at the bottom of the conventional multistage bath condenser-reboiler as 100.

TABLE 2

| | | Multistage bath condenser-reboiler of the present embodiment | | | Conventional multistage bath condenser-reboiler | |
|---|---|---|---|---|---|---|
| Number of condensation zone | | 2 | | | 1 | |
| Number of evaporation zones | | 6 | | | 6 | |
| Condensation zone | | C1 | C2 | | — | |
| Zone 1 | Inlet | 0 | | (8) | 0 | (8) |
| (E1) | Outlet | 17 | | | 17 | |
| Zone 2 | Inlet | 17 | | (25) | 17 | 25) |
| (E2) | Outlet | 33 | | | 33 | |
| Zone 3 | Inlet | 33 | | (42) | 33 | (42) |
| (E3) | Outlet | 50 | | | 50 | |
| Zone 4 | Inlet | | 0 | (8) | 50 | (58) |
| (E4) | Outlet | | 17 | | 67 | |
| Zone 5 | Inlet | | 17 | (25) | 67 | (75) |
| (E5) | Outlet | | 33 | | 83 | |
| Zone 6 | Inlet | | 33 | (42) | 83 | (92) |
| (E6) | Outlet | | 50 | | 100 | |
| Total condensation amount | | 100+ flow rate at outlet of Zone 3 flow rate at outlet of Zone 6 | | | 100: total flow rate at outlet of Zone 6 | |

The numbers in parentheses are average values.

The liquid flow rate in the condensation passage of the multistage bath condenser-reboiler in the present embodiment is the same as in the conventional example in the upper condensation zone (C1). However, all the liquid generated in the upper condensation zone (C1) is discharged from the liquid header 9 provided in the middle portion. Further, since gas having a zero liquefaction rate flows into the lower condensation zone (C2) from the middle gas header 8, the liquid flow rate in the lower condensation zone (C2) is smaller than the conventional one.

Specifically, the total amount of condensed fluid of the multistage bath condenser-reboiler of the present embodiment and the conventional multistage bath condenser-reboiler is 100, which is the same. However, the average liquid flow rates in zones E4, E5, and E6 of the conventional multistage bath condenser-reboiler were 58, 75, and 92, whereas the average liquid flow rates in the multistage bath condenser-reboiler in the present embodiment were as small as 8, 25, and 42. From this, it can be understood that the deterioration of the heat transfer performance in the lower condensation zone (C2) is suppressed.

It was confirmed that the multistage bath condenser-reboiler of the present embodiment having the above configuration was about 15% more compact than the conventional multistage bath condenser-reboiler.

Figure 2:
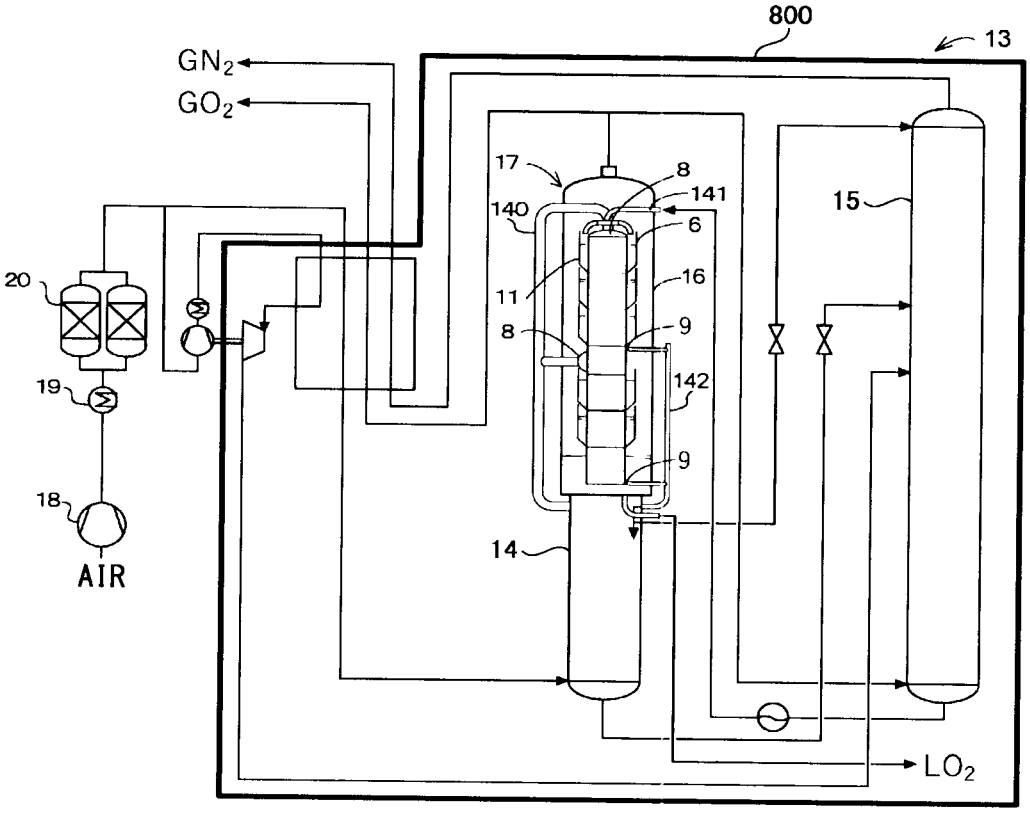
FIG. 2 is an explanatory diagram of a cryogenic air separation unit provided with the multistage bath condenser-reboiler including the heat exchange block shown in FIG. 1.

FIG. 2 shows a cryogenic air separation unit including the multistage bath condenser-reboiler having the heat exchange block 11 shown in FIG. 1. In FIG. 2, the same parts as those in FIG. 1 are designated by the same reference numerals.

A cryogenic air separation unit 13 includes a high-pressure column 14, a low-pressure column 15, and a multistage bath condenser-reboiler 17 including the heat exchanger block 11 housed in a container 16, which are insulated by a cold box 800.

The air is compressed by an air compressor 18, precooled by an air precooler 19, purified by an air purifier 20, and supplied to the bottom of the high-pressure column 14. The supplied air comes into gas-liquid contact with the reflux liquid flowing down in the high-pressure column 14. As a result, nitrogen, which is more volatile component, is concentrated while ascending, and nitrogen gas is generated at the top of the high-pressure column 14.

Further, as the reflux liquid descending in the high-pressure column 14, oxygen, which is a less volatile component in the supplied air, is enriched, and oxygen-enriched liquid air is generated at the bottom of high-pressure column 14. The oxygen-enriched liquid air is supplied into the low-pressure column 15, and while descending due to gas-liquid contact with the ascending gas in the low-pressure column 15, oxygen, which is a less volatile component, is concentrated, and liquid oxygen is generated at the bottom of the low-pressure column 15. In addition, while the ascending gas ascends, nitrogen, which is a more volatile component, is concentrated, and nitrogen gas is generated at the top of the low-pressure column 15.

The nitrogen gas generated at the top of the high-pressure column 14 is supplied into the gas headers 8 at the top and the middle of the heat exchange block 11 via a pipeline 140. The nitrogen gas is then condensed by heat exchange with the liquid oxygen supplied through a liquid oxygen supply pipe 141, discharged as liquid nitrogen from the liquid headers 9 at the middle and bottom, and returned into the high-pressure column 14 through a pipe 142. The liquid nitrogen returned into the high-pressure column 14 becomes the reflux liquid of the low-pressure column 15.

On the other hand, the liquid oxygen supplied through the liquid oxygen supply pipe 141 evaporates, and some of the liquid oxygen evaporated is collected as a product $GO_2$ and introduced into the bottom of the low-pressure column 15 to become the ascending gas.

In the cryogenic air separation unit 13 of the present embodiment, the deterioration of the heat transfer performance was suppressed by using the multistage bath condenser-reboiler 17 of the embodiment above. Further, since the multistage bath condenser-reboiler 17 is miniaturized, the cold box 800 is also miniaturized, and the equipment cost can be reduced.

In addition, since the heat transfer performance is suppressed from decreasing while achieving miniaturization, it is possible to suppresses a pressure increase of the nitrogen gas flowing into the condensation passage 1, that is, a pressure increase in the high-pressure column 14, and an increase in operating cost can be suppressed.

EXPLANATION OF REFERENCE NUMERAL

1, 10 condensation passage
- 111 condensation inlet flow channel
- 112 condensation outlet flow channel

2 evaporation passage
- 21 evaporation passage inlet
- 22 evaporation passage outlet

3 heat exchange section

5 liquid communication section

51 liquid communication section inlet
52 liquid communication section outlet
6 liquid reservoir
7 heat exchange core
8 gas header
9 liquid header
11 heat exchange block
13 cryogenic air separation unit
14 high-pressure column
140, 142 pipeline
141 liquid oxygen supply pipe
15 low-pressure column
16 container
17 multistage bath condenser-reboiler
18 air compressor
19 air precooler
20 air purifier
800 cold box
C1 upper condensation zone
C2 lower condensation zone
E1 to E6 evaporation zone

The invention claimed is:

1. A multistage bath condenser-reboiler, comprising:

only a single heat exchange core comprising a heat exchange section formed by adjacently stacking an evaporation passage through which a liquid to be evaporated flows, which is partitioned into a plurality of stages, and formed by plates and fins, and a condensation passage through which a gas is condensed by heat exchange with the liquid, and formed by plates and fins;

a liquid reservoir configured to store the liquid which is supplied into each stage of the evaporation passage;

a liquid communication passage which is configured to flow the liquid from the liquid reservoir into a lower liquid reservoir;

wherein the liquid reservoir and the lower liquid reservoir are provided to respective stages of the evaporation passage on at least one side surface in a width direction of the heat exchanger core, which is orthogonal to a stacking direction of the condensation passage and the evaporation passage, wherein the condensation passage is partitioned into at least first and second stages that are independent of one another, wherein a first plurality of evaporation stages in which evaporated gas does not flow through each other are provided independently to a first stage of the condensation passage;

wherein a second plurality of evaporation stages in which evaporated gas does not flow through each other are provided independently to a second stage of the condensation passage;

wherein evaporated gases of the first plurality of evaporation stages and the second plurality of evaporation stages do not pass through each other such that there is no flow of evaporated gas between the first plurality of evaporation stages and the second plurality of evaporation stages; and wherein the multistage bath condenser-reboiler further comprises:

a first gas header which is provided at the top of the first stage of the condensation passage to supply the gas into the first stage of the condensation passage;

a second gas header which is provided at the top of the second stage of the condensation passage to supply the gas into the second stage of the condensation passage;

first condensation inlet flow channels which introduce the gas supplied in the first gas header into the first stage of the condensation passage;

second condensation inlet flow channels which introduce the gas supplied in the second gas header into the second stage of the condensation passage;

a first liquid header which is provided at the bottom of the first stage of the condensation passage, and only collects a liquid generated by condensation of the gas in the first stage of the condensation passage, a second liquid header which is provided at the bottom of the second stage of the condensation passage, and only collects a liquid generated by condensation of the gas in the second stage of the condensation passage, first condensation outlet flow channels which flow out the liquid generated by condensation into the first liquid header; and second condensation outlet flow channels which flow out the liquid generated by condensation into the second liquid header.

2. The multistage bath condenser-reboiler according to claim 1, wherein the liquid communication passage is provided on at least one side surface in a stacking direction of the heat exchange core.

3. A cryogenic air separation unit comprising the multistage bath condenser-reboiler according to claim 1.

* * * * *